US008915382B2

(12) United States Patent
Totman

(10) Patent No.: US 8,915,382 B2
(45) Date of Patent: Dec. 23, 2014

(54) APPARATUS AND SYSTEM FOR SUPPORTING A SKI

(76) Inventor: Peter Totman, Ogden, UT (US)

( * ) Notice: Subject to any disclaimer, the term of this patent is extended or adjusted under 35 U.S.C. 154(b) by 367 days.

(21) Appl. No.: 12/882,934

(22) Filed: Sep. 15, 2010

(65) Prior Publication Data

US 2011/0062295 A1 Mar. 17, 2011

Related U.S. Application Data

(60) Provisional application No. 61/276,617, filed on Sep. 15, 2009.

(51) Int. Cl.

| | |
|---|---|
| ***A47F 7/00*** | (2006.01) |
| ***A47B 96/06*** | (2006.01) |
| ***A47F 5/00*** | (2006.01) |
| ***A63C 11/02*** | (2006.01) |

(52) U.S. Cl.

CPC ..... *A63C 11/028* (2013.01)
USPC .... 211/70.5; 211/87.01; 211/175; 211/94.01; 211/94.02; 211/113; 211/35; 248/205.1; 248/274.1; 248/298.1; 248/393; 248/424

(58) Field of Classification Search

USPC ..... 248/205.1, 274.1, 298.1, 222.52, 393, 248/424; 211/70.5, 87.01, 175, 94.01, 211/94.02, 113, 35

See application file for complete search history.

(56) References Cited

U.S. PATENT DOCUMENTS

| | | | | |
|---|---|---|---|---|
| D34,820 | S | 7/1901 | Christmann | |
| 1,958,497 | A * | 5/1934 | Rivers | 411/368 |
| 2,919,032 | A * | 12/1959 | Sinawski | 211/70.5 |
| 3,826,378 | A | 7/1974 | Novak | |
| 3,905,481 | A | 9/1975 | Laterra | |
| 4,033,460 | A * | 7/1977 | Alexandre | 211/70.5 |
| 4,062,453 | A | 12/1977 | Gorlach | |
| 4,222,490 | A * | 9/1980 | Wood, Jr. | 211/70.5 |
| 4,271,997 | A | 6/1981 | Michael | |
| 4,319,686 | A | 3/1982 | Avocat | |
| 4,508,229 | A | 4/1985 | Yost, Jr. | |
| 4,522,379 | A * | 6/1985 | Lindgren | 269/47 |
| 4,621,737 | A | 11/1986 | Casey | |
| 4,635,800 | A | 1/1987 | Stempin | |
| 4,673,088 | A | 6/1987 | Mancini | |
| 4,678,087 | A | 7/1987 | York | |
| 4,688,685 | A | 8/1987 | Brace | |

(Continued)

OTHER PUBLICATIONS

Ski and Snowboard Storage Racks, CozyWinters.com, downloaded on Sep. 15, 2010, http://cozywinters.com/storage/.

*Primary Examiner* — Terrell McKinnon
*Assistant Examiner* — Christopher Garft
(74) *Attorney, Agent, or Firm* — Goucher Patent Law; Tyler Goucher

(57) ABSTRACT

An apparatus and system are disclosed for supporting a ski on a support structure. The apparatus includes a ski support member, a spacer, and a coupling element. The ski support member includes a ski engaging portion and a binder engaging portion. The binder engaging portion is positionable within a receiving space in a binder toe piece. The ski engaging portion includes a substantially flat surface engageable with one of a deck surface of the ski and an element disposed on the deck surface of the ski to maintain the ski in a desirable orientation. The spacer is positioned between the ski support member and a the support structure. The coupling element is configured to couple the ski support member to the support structure.

19 Claims, 15 Drawing Sheets

(56) References Cited

U.S. PATENT DOCUMENTS

| | | | | | |
|---|---|---|---|---|---|
| 4,705,177 | A | | 11/1987 | Oren | |
| 4,732,283 | A | | 3/1988 | Schmidt | |
| 4,763,797 | A | * | 8/1988 | Egan | 211/70.5 |
| 4,778,065 | A | | 10/1988 | Chiarot | |
| 4,793,496 | A | | 12/1988 | Wait | |
| 4,798,298 | A | | 1/1989 | Ursetta | |
| 4,988,007 | A | | 1/1991 | Chiarot | |
| D317,114 | S | * | 5/1991 | Raffler | D8/367 |
| 5,147,049 | A | * | 9/1992 | Schwendemann et al. | 211/70.5 |
| 5,150,887 | A | * | 9/1992 | Weissenborn et al. | 269/71 |
| 5,193,694 | A | | 3/1993 | Wave | |
| 5,236,183 | A | * | 8/1993 | Curtis | 269/253 |
| 5,285,906 | A | | 2/1994 | Wisnowski et al. | |
| 5,307,944 | A | * | 5/1994 | Reedy | 211/70.5 |
| 5,316,155 | A | * | 5/1994 | Collins et al. | 211/70.5 |
| 5,417,335 | A | | 5/1995 | White | |
| 5,649,633 | A | | 7/1997 | Bellerose | |
| 5,806,691 | A | | 9/1998 | Nelson | |
| 5,860,536 | A | | 1/1999 | Rotzien | |
| 5,884,781 | A | | 3/1999 | Ehrhart | |
| 5,941,191 | A | * | 8/1999 | Dysarz | 114/218 |
| D423,339 | S | * | 4/2000 | Snell | D8/372 |
| 6,131,866 | A | * | 10/2000 | Kesinger | 248/225.11 |
| 6,164,465 | A | | 12/2000 | Schroeder | |
| D437,208 | S | * | 2/2001 | Snell | D8/372 |
| 6,196,397 | B1 | | 3/2001 | Maher | |
| 6,273,272 | B1 | | 8/2001 | Hake | |
| 6,712,226 | B1 | | 3/2004 | Williams, Jr. | |
| 7,284,671 | B1 | | 10/2007 | Doscher | |
| 7,717,278 | B2 | * | 5/2010 | Kao | 211/70.6 |
| 2006/0124812 | A1 | * | 6/2006 | Berardi | 248/225.11 |
| 2009/0230667 | A1 | * | 9/2009 | Starry | 280/814 |
| 2010/0244351 | A1 | * | 9/2010 | Totman | 269/296 |
| 2011/0062295 | A1 | * | 3/2011 | Totman | 248/205.1 |

* cited by examiner

APPARATUS AND SYSTEM FOR SUPPORTING A SKI

CROSS-REFERENCES TO RELATED APPLICATION

This application claims the benefit of U.S. Provisional Patent Application No. 61/276,617 entitled "SKI HANGER DEVICE FOR VERTICALLY STORING SNOW SKIS" and filed on Sep. 15, 2009 for Peter Totman, which is incorporated herein by reference.

FIELD

This subject matter of the present disclosure relates to storage of snow ski and more particularly relates to storing snow skis in a vertical orientation.

BACKGROUND

In the sport of skiing equipment, costs have skyrocketed in recent years. As a result of the increased equipment costs, skiing enthusiasts have become increasingly concerned with the care and storage of the equipment used to enjoy the sport.

Currently skis range in length from about 100 centimeters to 200 centimeters making the skis unwieldy and difficult to store. In the past, enthusiasts have stored the skis on end with the tails of the skis supported by the ground and the tips of the skis supported by a wall or other support structure. Storing a ski or pair of skis on end subjects the tail end of the skis to the possibility of damage from the ground upon which the skis are supported.

Ski racks have been developed that store skis with the side of the skis parallel to a support structure such that the deck surface of the ski is positioned perpendicular to the support structure. The distance between the top of each skis binders is substantially larger than the distance between a ski binders braking element. Thus, storing a pair of skis with the edge of the skis parallel to a support structure increases the lateral distance occupied by the skis.

SUMMARY

From the foregoing discussion, it should be apparent that a need exists for an apparatus and system that stores a ski or a pair of skis at some distance above the ground. Beneficially, such an apparatus and system would store the ski or pair of skis with a deck surface of the ski parallel to a support structure.

The subject matter of the present disclosure has been developed in response to the present state of the art, and in particular, in response to the problems and needs in the art that have not yet been fully solved by currently available ski racks. Accordingly, the present subject matter has been developed to provide an apparatus and system for storing skis that overcome many or all of the above-discussed shortcomings in the art.

According to one embodiment, an apparatus is provided for supporting a ski on a support structure. The ski includes a binder toe piece coupled to a deck surface of the ski. The binder toe piece includes a boot retention flange that extends parallel to the deck surface of the ski. The deck surface and the boot retention flange define a receiving space for receiving a toe end of a ski boot.

In certain embodiments the apparatus for supporting a ski includes a ski support member, a spacer, and a coupling element. The ski support member includes a ski engaging portion and a binder engaging portion. The binder engaging portion is positionable within the receiving space defined by the deck surface of the ski and the boot retention flange. The ski engaging portion has a substantially flat surface that is engageable with one of the deck surface of the ski and an element disposed on the deck surface of the ski to maintain the ski in a desirable orientation.

The spacer, in one embodiment, is positioned between the ski support member and the support structure. A coupling element couples the ski support member to the support structure. In certain embodiments the coupling element also couples the spacer to the support structure.

In specific implementations of the apparatus, the desirable orientation is a vertical orientation. In the vertical orientation a longitudinal axis of the ski is substantially vertical with the deck surface of the ski facing the support structure. The transverse axis of the ski is substantially horizontal when the ski is position in the desirable orientation.

In one implementation of the apparatus, a retention member is coupled to the ski support member. The retention member is configured to encircle the ski to maintain the binder engaging portion of the ski support member within the ski receiving space.

In some implementations of the apparatus, the binder engaging portion of the ski support member includes a first surface positioned opposite a second surface with an end surface extending between the first surface and the second surface. In an engaged position the end surface is positioned within the receiving space and the first surface engages the boot retention flange of the binder toe piece.

According to some implementations of the apparatus, the end surface of the ski support member is contoured to match a contour of the receiving space in the binder toe piece. In such an embodiment, the binder engaging portion of the ski support member is matingly receivable within the receiving space.

In certain implementations of the apparatus, engagement between the ski engaging portion and either the deck surface of the ski, or an element disposed on the deck surface of the ski prevents rotation of the ski about a transverse axis of the ski. The transverse axis is substantially transverse to the deck surface of the ski. Positioning of the binder engaging portion of the ski support member within the receiving space prevents rotation of the ski about a longitudinal axis of the ski and a third axis of the ski. In one embodiment, the longitudinal axis of the ski is an axis substantially perpendicular to the transverse axis and the third axis is substantially perpendicular to the longitudinal axis and substantially perpendicular to the transverse axis.

In some implementations of the apparatus, an adjusting member facilitates adjustment of a position of the ski support member relative to the support structure. In one implementation, the apparatus includes a fastener and the adjusting member is a channel elongated in a lengthwise direction substantially perpendicular to the longitudinal axis of the ski when the ski is positioned on the ski support member. The fastener is receivable within the channel and movable along the lengthwise direction. The coupling element is positionable through the ski support member and engageable with the fastener. The fastener engages the channel to position the ski support member at a desired position relative to the support structure.

In one implementation of the apparatus, the coupling element and the fastener are threaded. Rotation of the coupling element in a first direction increases a coupling force between the ski support member and the channel to limit movement of the ski support member with respect to the channel.

According to some implementations, a contact bumper is positioned between the deck surface of the ski and the substantially flat surface of the ski engaging portion of the ski support member. In one implementation, the contact bumper comprises an elastomeric material deformable with a pressure applied to the contact bumper by one of the deck surface of the ski and an element disposed on the deck surface of the ski.

In certain implementations of the apparatus, the binder engaging portion of the ski support member comprises a substantially rigid loop having a contour that matches a contour of the receiving space. In such an implementation, the substantially rigid loop is matingly receivable within the receiving space to position the ski in a desirable orientation.

Reference throughout this specification to features, advantages, or similar language does not imply that all of the features and advantages that may be realized with the present subject matter should be or are in any single embodiment. Rather, language referring to the features and advantages is understood to mean that a specific feature, advantage, or characteristic described in connection with an embodiment is included in at least one embodiment. Thus, discussion of the features and advantages, and similar language, throughout this specification may, but do not necessarily, refer to the same embodiment.

Furthermore, the described features, advantages, and characteristics of the subject matter may be combined in any suitable manner in one or more embodiments. One skilled in the relevant art will recognize that the subject matter may be practiced without one or more of the specific features or advantages of a particular embodiment. In other instances, additional features and advantages may be recognized in certain embodiments that may not be present in all embodiments.

These features and advantages of the present subject matter will become more fully apparent from the following description and appended claims, or may be learned by the practice of the subject matter as set forth hereinafter.

BRIEF DESCRIPTION OF THE DRAWINGS

In order that the advantages of the subject matter will be readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment.

Furthermore, the described features, structures, or characteristics of the subject matter may be combined in any suitable manner in one or more embodiments. One skilled in the relevant art will recognize, however, that the subject matter may be practiced without one or more of the specific details, or with other methods, components, materials, and so forth. In other instances, well-known structures, materials, or operations are not shown or described in detail to avoid obscuring aspects of the subject matter.

Figure 1:
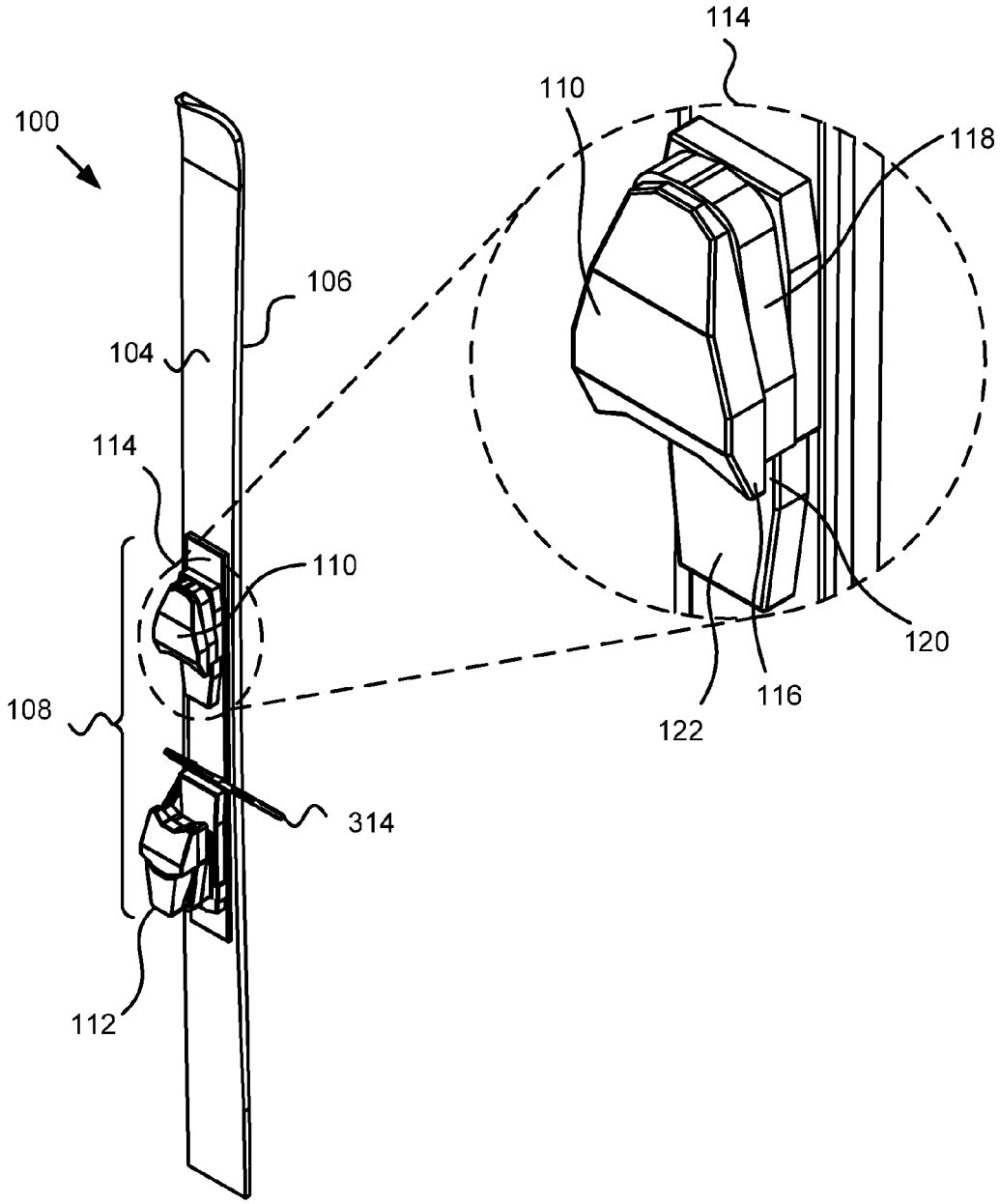
FIG. 1 depicts a front perspective view of one embodiment of a ski having a binder coupled to a deck surface of the ski.

FIG. 1 depicts a perspective view of one embodiment of a ski 102 having a deck surface 104 and a base surface 106. A binder 108 is coupled to the deck surface 104 of the ski 102. The binder 108 includes a binder toe piece 110 and a binder heel piece 112. The binder toe piece 110 and the binder heel piece 112 facilitate coupling a user's boot (not shown) to the ski 102. In use, a toe end of a ski boot and a heel end of a ski boot are removably engaged with the binder toe piece 110 and the binder heel piece 112 respectively to couple the user's boot to the ski 102.

In the embodiment illustrated in FIG. 1, a binder toe piece coupling area 114 has been enlarged to further illustrate the features of the binder toe piece 110. In certain embodiments, the binder toe piece 110 includes a main body 118 and a boot retention flange 116. The boot retention flange 116 is oriented in a plane substantially parallel to the deck surface 104 of the ski 102 and extends in the direction of the binder heel piece 112. The boot retention flange 116 extends beyond the main body 118 of the binder toe piece 110.

In certain embodiments, the boot retention flange 116 and the deck surface 104 of the ski 102 define a receiving space 120 therebetween for receiving the toe end of a ski boot. In other embodiments, a stomp plate 122 may be coupled to the deck surface 104 of the ski 102 such that the receiving space 120 is defined between the boot retention flange 116 and an element (the stomp plate 122) disposed on the deck surface 104 of the ski 102.

Figure 2:
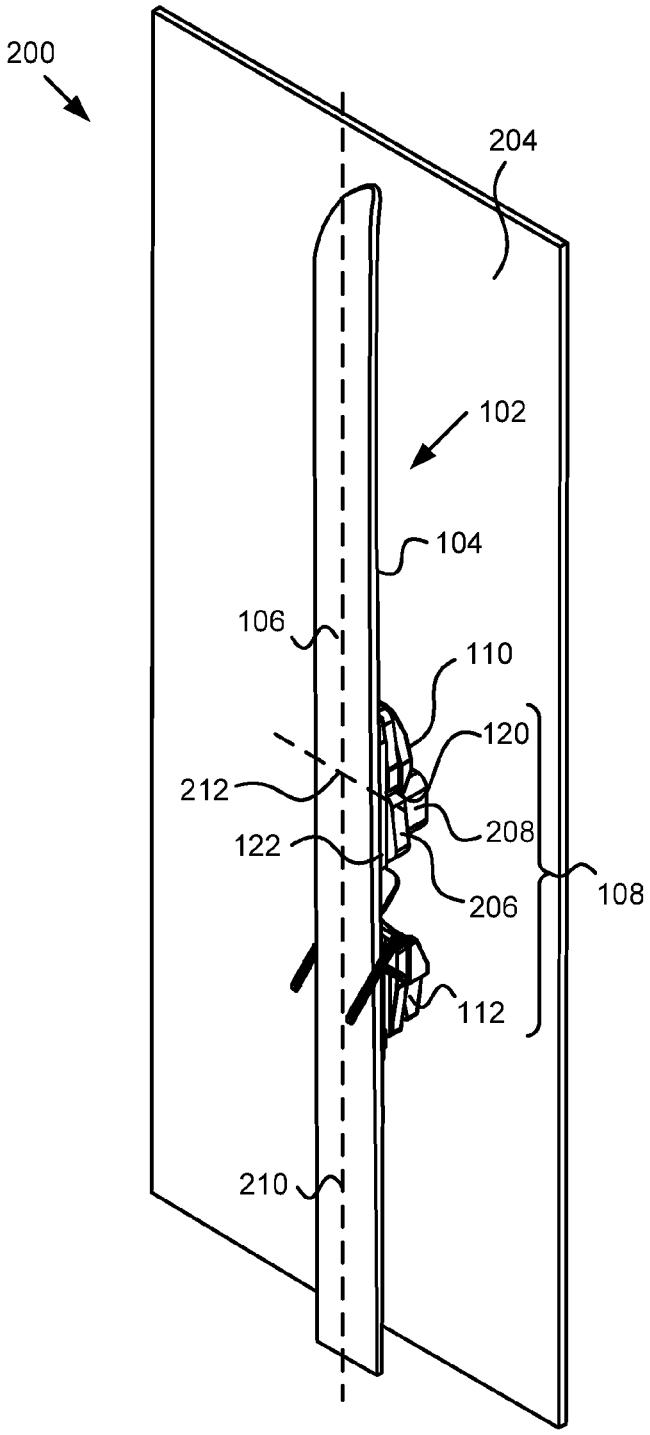
FIG. 2 depicts a front perspective view of one embodiment of an apparatus for supporting a ski or pair of skis on a support structure with one ski positioned on a ski support member.

FIG. 2 depicts a perspective view of one embodiment of an apparatus 200 for supporting a ski 102 on a support structure 204. In certain embodiments the apparatus 200 includes a ski support member 206, a spacer 208, and a coupling element, which can include first and second coupling elements 402*a*, 402*b* (see, e.g., FIG. 4).

In the embodiment illustrated in FIG. 2, the support structure 204 is a wall. One of skill in the art will recognize in view of this disclosure that in other embodiments the support structure 204 may be any other structure capable of support the weight of a ski 102 or a pair of skis 102.

In certain embodiments, the ski support member 206 is positioned within the receiving space 120 in the binder toe piece 110 and engages the binder toe piece 110 and stomp plate 122 to maintain the ski 102 in a desirable orientation. In other embodiments, such as where the binder toe piece 110 does not include a stomp plate 122, the ski support member 206 may engage the deck surface 104 of the ski 102 and the binder toe piece 110 to maintain the ski 102 in a desirable orientation.

In one embodiment, in the desirable orientation, the ski 102 is positioned in a substantially vertical orientation with the deck surface 104 of the ski 102 facing the support structure 204. In the vertical orientation, a longitudinal axis 210 of the ski 102 is substantially vertical and a transverse axis 212 is substantially horizontal.

In certain embodiments, a spacer 208 is positioned between the ski support member 206 and the support structure 204. In one embodiment, the spacer 208 positions the ski support member 206 a sufficient distance from the support structure 204 to avoid interference of the binder toe piece 110 or the binder heel piece 112 with the support structure 204. One of skill in the art will recognize in view of this disclosure that the size of the spacer 208 may be varied to accommodate different binder 108 configurations and sizes. In other embodiments, the binder toe piece 110 and/or the binder heel piece 112 may contact the support structure 204. In such an embodiment, the support structure 204 may assist in maintaining the deck surface 104 of the ski 102 parallel to the support structure 204.

The coupling elements 402*a*, 402*b* (see, e.g., FIG. 4), in certain embodiments, are positionable through the ski support member 206 and the spacer 208 and are coupleable to the support structure 204 to attach the ski support member 206 and the spacer 208 to the support structure 204. In the embodiment illustrated in FIG. 4, each coupling element 402*a*, 402*b* comprises a fastener, such as a screw or other threaded fastener positioned through the ski support member 206 and the spacer 208 and coupled to the support structure 204. In other embodiments, the coupling elements 402*a*, 402*b* may be nails or other driven fasteners that are drivable through the ski support member 206 and the spacer 208 and engageable with the support structure 204. In yet another embodiment, the coupling element may comprise a chemical adhesive that bonds the ski support member 206 to the spacer 208 and bonds the spacer 208 to the support structure 204. Although the coupling elements 402*a*, 402*b* of the illustrated embodiments are two separate elements, the coupling element can be a single coupling element or more than two coupling elements.

While the embodiment illustrated in FIG. 2 depicts the ski support member 206 and the spacer 208 as separate components, one of skill in the art will recognize that in certain embodiment the ski support member 206 and the spacer 208 may be a single unitarily molded component. In such an embodiment, the coupling elements 402*a*, 402*b* may couple the combined ski support member 206 and spacer 208 to the support structure 204.

Figure 3:
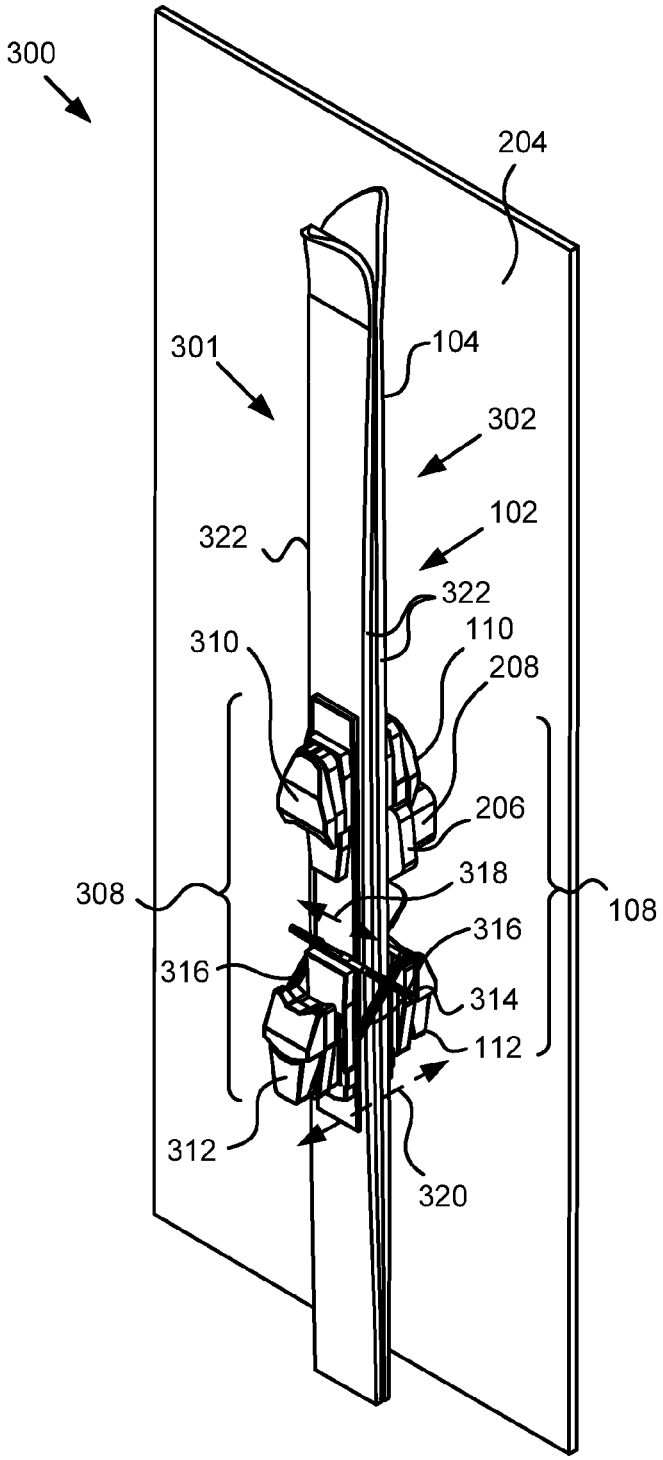
FIG. 3 depicts a front perspective view of another embodiment of an apparatus for supporting a ski or pair of skis on a support structure with a pair of skis supported by a ski support member.

FIG. 3 depicts a perspective view of another embodiment of the apparatus 200 for supporting a ski 102 on a support structure 204. In certain embodiments, the apparatus 200 may be used to support a pair 302 of skis on a support structure 204.

One of skill in the art will recognize that each ski 102, 301 in a pair of skis 302 are typically substantially mirror images of one another. Thus, in certain embodiments, a second ski 301 includes a binder 308 having a binder toe piece 310 and a binder heel piece 312.

With most modern skis, the binders 108, 308 include a ski braking element 314, 316 respectively. The ski braking elements 314, 316 operate to slow or stop the skis 102, 301 when a user's boots (not shown) are disengaged from the binders 108, 308 due to a crash or excessive force exerted by the user's boot on the binder 108, 308. When a user's boots are engaged with the binders 108, 308, the ski braking elements 314, 316 are positioned adjacent to the side walls 322 of the skis 102, 301 to allow the skis 102, 301 to travel down the ski slope without interference from the ski braking elements 314, 316.

In certain embodiments, the ski braking elements 314, 316 also facilitate coupling the second ski 301 to the first ski 102. For example, in certain embodiments, the ski braking element 314 of the second ski 301 is positioned around, and engaged with, the ski braking element 316 of the first ski 102. Engagement between the ski braking element 314 of the second ski 301 and the ski braking element 316 of the first ski 102 allows the first ski 102 to support the second ski 301. Where the binder toe piece 110 of the first ski 102 is engaged with, and supported by, the ski support member 206, the second ski 301 is also supported by the ski support member 206 by virtue of the engagement between the ski braking elements 314, 316.

In certain embodiments, a distance 318 between the outer edges of the ski braking elements 314, 316 is less than a distance 320 between the top surfaces of the ski binders 108, 308 when the skis 102, 301 are coupled to one another by the ski braking elements 314, 316. Thus, by positioning the first ski 102 with the deck surface 104 facing the support structure 204 and coupling the skis 102, 301 by the ski braking elements 314, 316, the physical space on the support structure 204 occupied by the skis 108, 301 is less than if the skis 108, 301 were positioned on the support structure 204 with the deck surface 104 of the ski 102 positioned perpendicular to the support structure 204.

Figure 4:
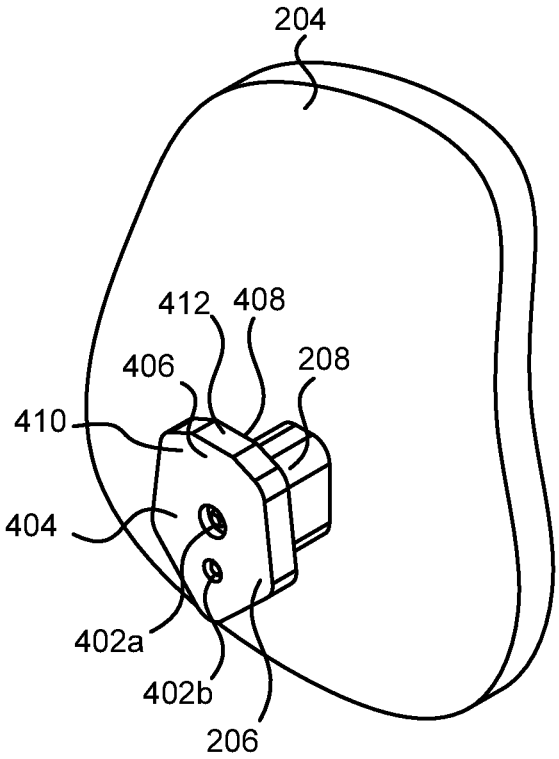
FIG. 4 depicts a front perspective view of another embodiment of an apparatus for supporting a ski or pair of skis on a support structure.

FIG. 4 depicts a perspective view of another embodiment of the apparatus 200 for supporting a ski 102 or pair of skis 302 of FIGS. 2 and 3 with the skis 302 removed for clarity. The ski support member 206, in certain embodiments, includes a ski engaging portion 404 and a binder engaging portion 406. The binder engaging portion 406 is positionable within the receiving space 120 defined by the boot retention flange 116 and either the deck surface 104 of the ski 102 or an element, such as the stomp plate 122, positioned on the deck surface 104 of the ski 102.

In one embodiment, the binder engaging portion 406 of the ski support member 206 includes a first surface 408 positioned opposite a second surface 410 with an end surface 412 extending between the first surface 408 and the second surface 410. When the ski support member 206 is positioned in an engaged position to support the ski 102, the end surface 412 is positioned within the receiving space 120 in the binder toe piece 110. In the engaged position, the first surface 408 engages the boot retention flange 116 of the binder toe piece 110.

In certain embodiments, the end surface 412 of the binder engagement portion 406 is contoured to match a contour of the receiving space 120 in the binder toe piece 110. In such an embodiment, the binder engagement portion 406 of the ski support member 206 is matingly receivable within the receiving space 120. In other embodiments, the end surface 412 of the binder engagement portion 406 may be shaped such that the end surface 412 makes contact with at least two points of the binder toe piece 110 defining the receiving space 120 to prevent rotation of the ski 102 from side to side.

In embodiments where the end surface 412 of the binder engagement portion 406 is contoured to match a contour of the receiving space 120 in the binder toe piece 110, two or more coupling elements 402 are positioned through the ski support member 206 and the spacer 208 to couple the ski support member 206 and the spacer 208 to the support structure 204. The two or more coupling elements 402 prevent rotation of the ski support member 206 and the spacer 208 such that the end surface 412 of the ski support member 206 remains aligned with the receiving space 120 in the binder toe piece 110. In other embodiments the ski support member 206 may be substantially circular such that the end surface 412 is substantially the same all the way around. In such an embodiment it may be unnecessary to align a specific portion of the end surface 412 with the receiving space 120 in the binder toe piece 110. Thus, in one embodiment, a single coupling element 402 may be used to couple the ski support member 206 and the spacer 208 to the support structure 204.

The ski engaging portion 404 of the ski support member 206 has a substantially flat surface that is engageable with either the deck surface 104 of the ski 102 or an element, such as a stomp plate 122, positioned on the deck surface 104 of the ski 102. The binder engagement portion 406 and the ski engaging portion 404 of the ski support member 206 cooperate with the binder toe piece 110 and the deck surface 104 of the ski 102 or an element, such as a stomp plate 122, positioned on the deck surface 104 of the ski 102 to maintain the ski 102 in a desirable orientation.

Figure 5:
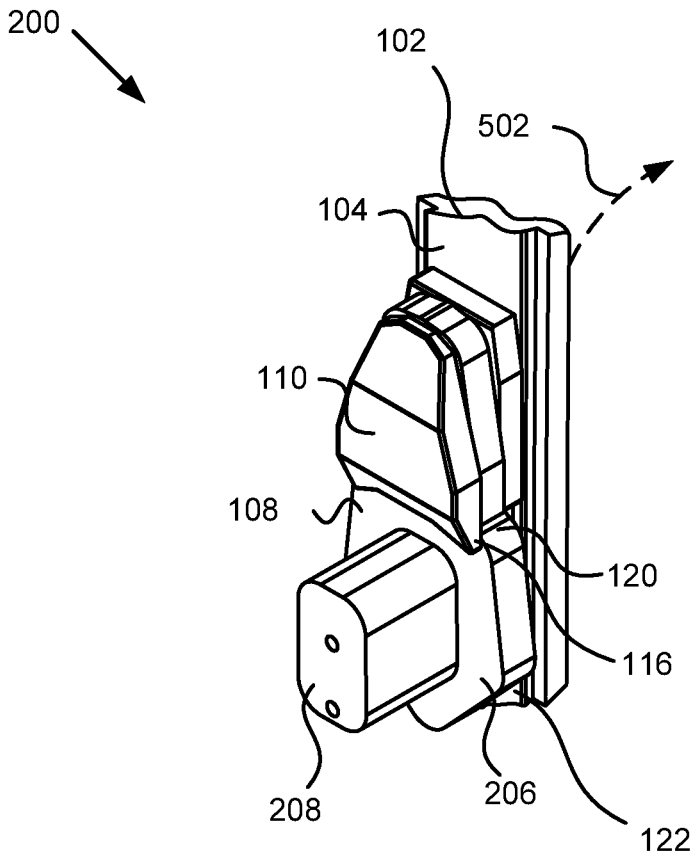
FIG. 5 depicts a rear perspective view of another embodiment of an apparatus for supporting a ski or pair of skis on a support structure.

FIG. 5 depicts one embodiment of a rear perspective view of the apparatus 200 for supporting a ski 102 or pair of skis 302 of FIGS. 2 and 3 with the support structure 206 removed for clarity.

In the engaged position, the end surface 412 (see, e.g., FIG. 4) of the ski support member 206 is received within the receiving space 120 in the binder toe piece 110. In certain embodiments the ski support member 206 engages the binder toe piece 110 to support the ski 102 at some distance above the ground. In other embodiments the ski support member 206 engages the binder toe piece 110 to maintain the ski 102 in a desired position while the ski 102 rests on the ground or other supporting surface.

The first surface 408 of binder engaging portion 406 engages the boot retention flange 116 to stop movement of the ski 102 in the direction of arrow 502. Engagement between the ski engaging portion 404 of the ski support member 206 and one of the deck surface 104 of the ski 102 or an element, such as a stomp plate 122, positioned on the deck surface 104 of the ski 102 also stops movement of the ski 102 in the direction of arrow 502.

In certain embodiments the spacer 208 has a sufficient depth to position the ski 102 far enough away from the support structure 204 to avoid interference between the support structure 204 and the binder toe piece 110 and/or the binder heel piece 112. In one embodiment the apparatus 200 may include additional or various sized spacer's 208 positionable between the ski support member 206 and the support structure 204 to adjust the distance between the ski 102 and the support structure 204. In other embodiments, the binder toe piece 110 and/or the binder heel piece 112 may contact the support structure 204. In such an embodiment the support structure 204 may assist in maintaining the deck surface 104 of the ski 102 parallel to the support structure 204.

Figure 6:
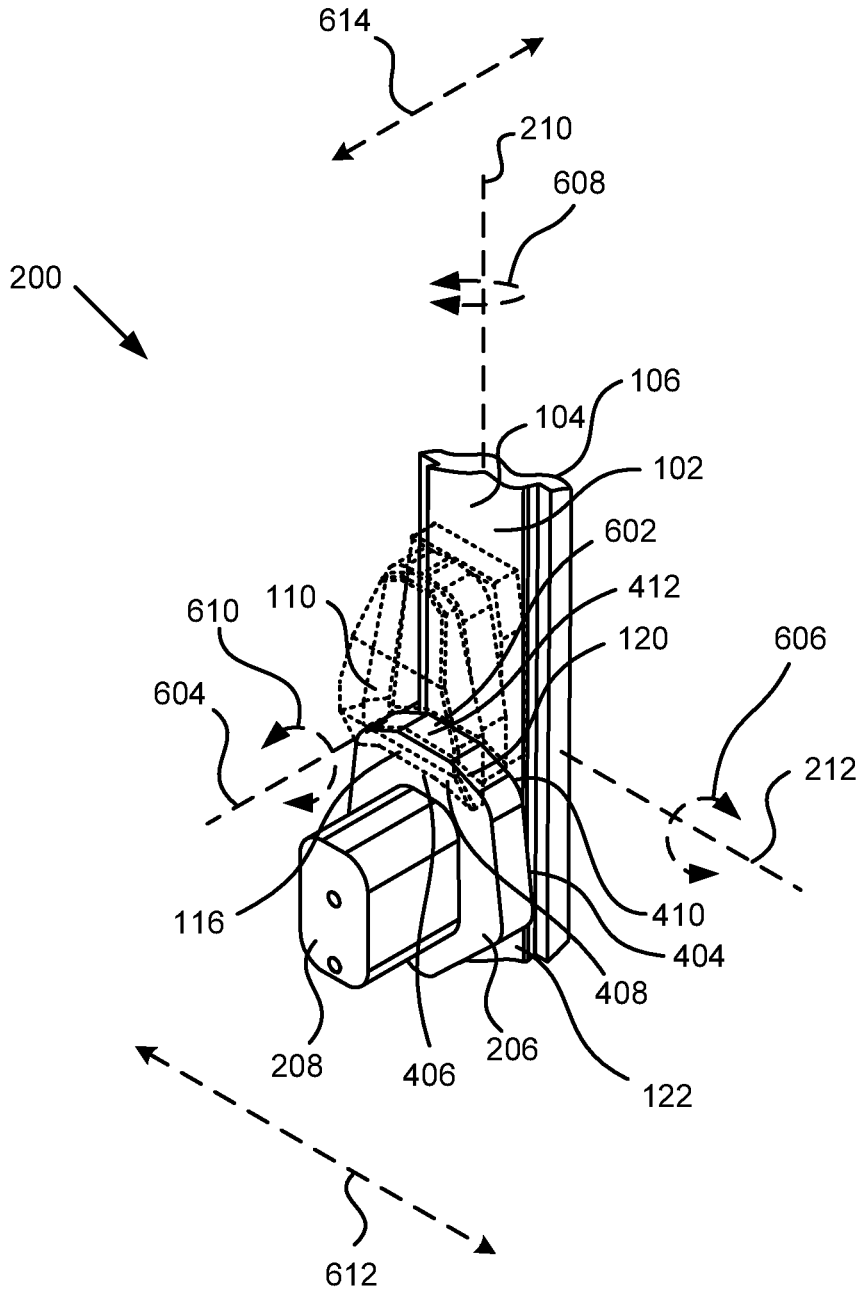
FIG. 6 depicts a rear perspective view of another embodiment of an apparatus for supporting a ski or pair of skis on a support structure.

FIG. 6 depicts another embodiment of a rear perspective view of the apparatus 200 for supporting a ski 102 or pair of skis 302. In the embodiment illustrated in FIG. 6, the binder toe piece 110 is depicted as transparent to show the engagement between the end surface 412 of the binder engagement portion 406 of the ski support member 206 and the receiving space 120 in the binder toe piece 110.

In certain embodiments, engagement between the ski engaging portion 404 and either the deck surface 104 of the ski 102 or an element disposed on the deck surface 104 of the ski 102 prevents rotation of the ski 102 about the transverse axis 212 of the ski 102 in the direction of arrows 606.

In one embodiment, positioning the binder engagement portion 406 within the receiving space 120 prevents rotation of the ski 102 about the longitudinal axis 210 in the direction of arrows 608. Positioning the binder engagement portion 406 within the receiving space also prevents rotation of the ski about a third axis 604 in the direction of arrow 610. The longitudinal axis 210 is substantially perpendicular to the transverse axis 212 and the third axis 604 is substantially perpendicular to both the longitudinal axis 210 and the transverse axis 212. Thus, in the embodiment illustrated in FIG. 6, the longitudinal axis 210 extends along the length of the ski 102 and the transverse axis 212 extends across the width of the ski 102, extending across the side walls 322 (see, e.g., FIG. 3) of the ski 102. The third axis 604 extends through deck surface 104 and base surface 106.

In certain embodiments, the end surface 412 of the binder engagement portion 406 is contoured to match a contour of an inner wall 602 within the receiving space 120 in the binder toe piece 110. In such an embodiment, engagement between the binder engagement portion 406 and the receiving space 120 operates to limit lateral movement of the ski 102 in the direction of arrows 612. Engagement between the binder engagement portion 406 and the receiving space 120 also operates to limit rotation of the ski 102 about the third axis 604 in the direction of arrows 610. This prevents tipping of the ski 102 from side to side.

In other embodiments, the binder engagement portion 406 of the ski support member 206 is not contoured to match the contour of the inner wall 602 within the receiving space 120 in the binder toe piece 110. In such an embodiment, the end surface 412 of the binder engagement portion 406 may be shaped to contact the inner wall 602 within the receiving space 120 in at least two positions to limit rotation of the ski 102 about the third axis 604 in the direction of arrows 610. In one embodiment, at least a portion of the end surface 412 extends into the receiving space 120 and is held within the receiving space 120 by virtue of the contour of the inner wall 602 to limit lateral movement of the ski 102 in the direction of arrows 612.

The boot retention flange 116 engages the first surface 408 of the binder engagement portion 406 of the ski support member 206. The engagement between the first surface 408 of the binder engagement portion 406 and the boot retention flange 116 limits movement of the ski 102 in the direction of arrows 614. Engagement between the first surface 408 of the binder engagement portion 406 and the boot retention flange 116 also limits rotation of the ski 102 about the transverse axis 606.

Figure 7:
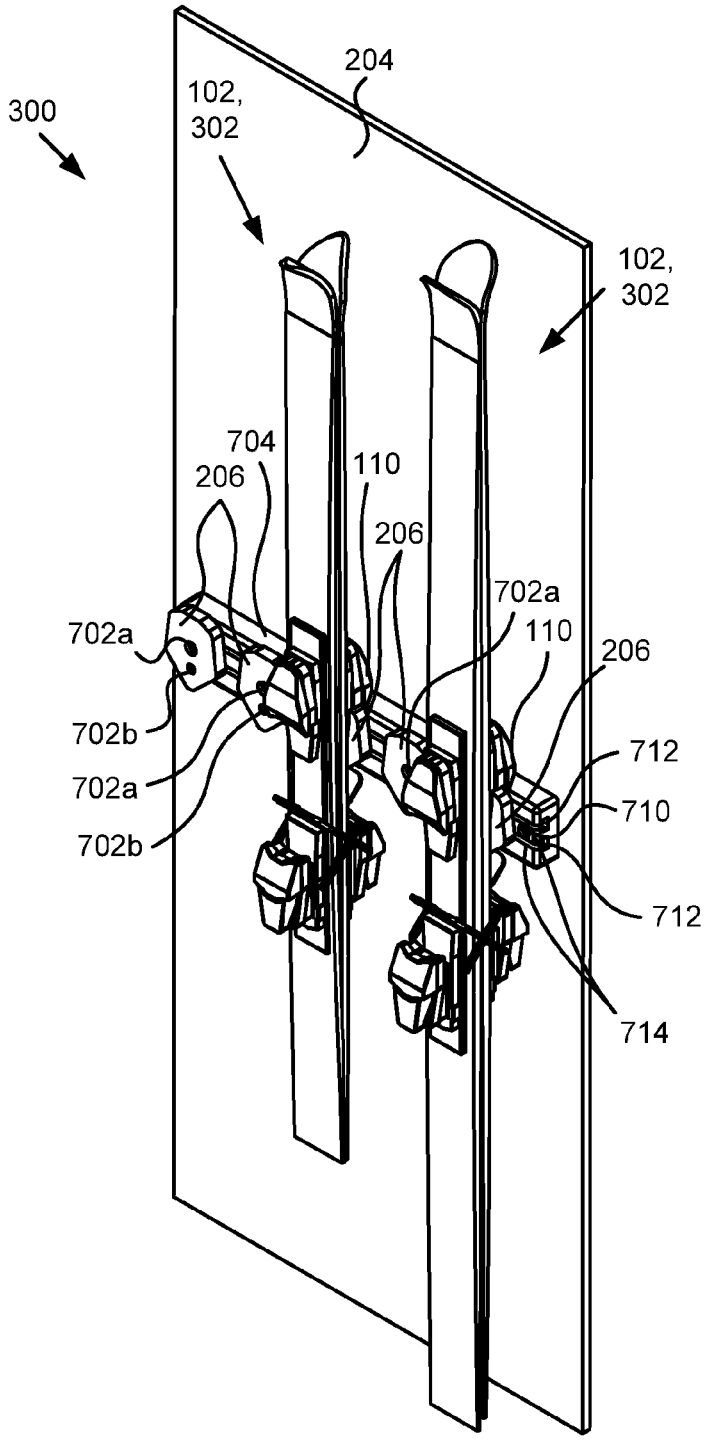
FIG. 7 depicts a front perspective view of one embodiment of an adjustable apparatus for supporting a plurality of skis or pairs of skis on a support structure.

FIG. 7 depicts a perspective view of one embodiment of an apparatus 300 for supporting a ski 102 or pair of skis 302 on a support structure 204. In certain embodiments the apparatus 300 includes a plurality of support members 206, a plurality of coupling elements 702, and a spacer 704. The ski support members 206, in certain embodiments, are substantially similar to the ski support member 206 discussed above with reference to apparatus 200. Thus, the ski support members 206 engage binder toe pieces 110 on a ski 102 or pair of skis 302 to position the ski 102 or pair of skis 302 in a desirable orientation.

In one embodiment the spacer 704 is an elongated member that is configured to receive one or more support members 206. The spacer 704 is elongated in a lengthwise direction substantially perpendicular to the longitudinal axis 210 of the ski 102 or pair of skis 302.

The spacer 704, in certain embodiments, is coupled to the support structure 204 by one or more fasteners 710, such as screws or other mechanical fasteners that extend through the spacer 704 and engage the support structure 204. In other embodiments, the spacer 704 is coupled to the support structure 204 by a chemical adhesive such as glue.

In certain embodiments, the apparatus 300 includes one or more adjusting members 712 that facilitate adjustment of a position of the ski support members 206 relative to the support structure 204. In one embodiment, the one or more adjusting members 712 are channels 714 elongated in a lengthwise direction substantially perpendicular to the longitudinal axis 210 of the ski 102 or skis 302 when the ski 102 or skis 302 are positioned in the vertical position.

A fastener (not shown) is received within each of the one or more channels 714. The fasteners are movable along the one or more channels 714 in the lengthwise direction. To position a support member 206 at a desired position, the coupling elements 702 are positioned through the ski support member 206 and engaged with the fasteners. The fasteners engage the channels 714 to position the ski support member 206 at a desired position relative to the support structure 204. In certain embodiments, in the desired position, each support member 206 is located a sufficient distance away from an adjacent support member 206 to allow the ski 102 or at least one of the skis 102 in a pair of skis 302 to be oriented with its deck surface 104 facing the support structure 204.

In certain embodiments, the coupling elements 702 and the fasteners are threaded such that rotation of the coupling element in a first direction increases a coupling force between the ski support member 206 and the channel 714 to limit movement of the ski support member 206 with respect to the channel 714. One of skill in the art will recognize that limiting movement of the ski support member 206 with respect to the channel 714 also limits movement of the ski support member 206 with respect to the support structure 204 when the spacer 704 is mounted to the support structure 204.

Figure 8:
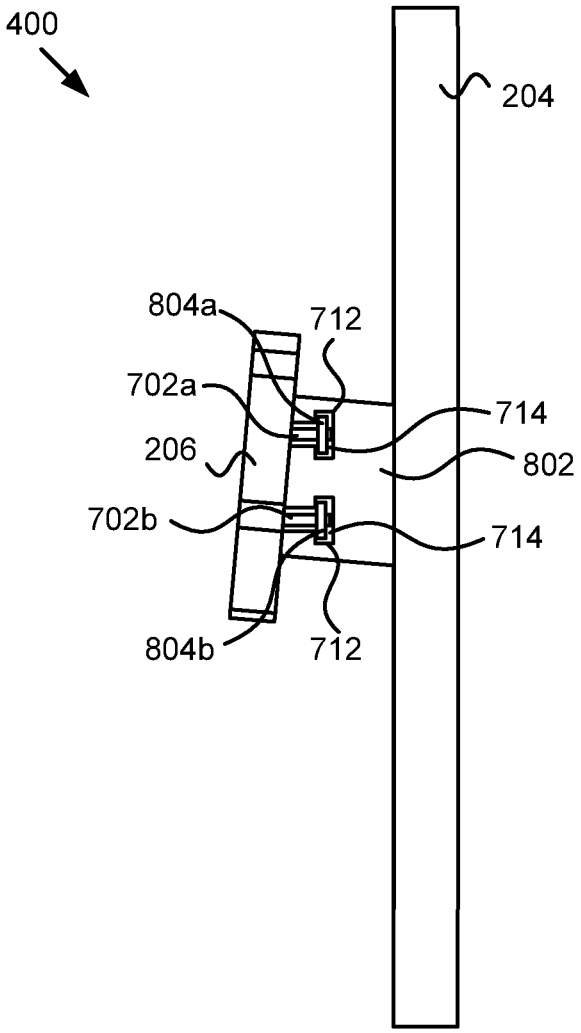
FIG. 8 depicts a side view of another embodiment of a apparatus for supporting a ski or pair of skis on a support structure.

FIG. 8 depicts a side view of another embodiment of an apparatus 400 for supporting a ski 102 or pair of skis 302 on a support structure 204. The apparatus 400 includes a ski support member 206, a spacer 802, and one or more coupling elements 402. In certain embodiments the ski support member 206 and the coupling elements 702 may be substantially similar to the ski support member 206 and the coupling elements 702 discussed above.

In certain embodiments, the spacer 802 may be canted such that the ski support member 206 is positioned at an angle with respect to the surface of the support structure 204 facing the ski 102 when the ski is positioned on the ski support member 206. One of skill in the art will recognize that in certain embodiments a binder toe piece 110 may be substantially smaller than a binder heel piece 112. By positioning the support member 206 at an angle, the ski 102 or skis 302 are positioned at an angle to accommodate a larger binder heel piece 112. In certain embodiments, positioning the support member 206 at an angle also facilitates engagement between the ski engaging portion 404 and the deck surface 104 of the ski 102 as positioning the tail of the ski 102 at an angle other than parallel to the support structure 204 increases the pressure between the ski engaging portion 404 and the deck surface 104 of the ski 102. The weight of the tail of the ski increases the pressure between the ski engaging portion 404 and the deck surface 104 of the ski 102.

While the embodiment illustrated in FIG. 8 depicts the spacer 802 as being canted, one of skill in the art will recognize that in other embodiments the ski support member may be canted. In another embodiment, the support structure 204 may be configured to cant both the spacer 802 and the ski support member 206.

Like the apparatus 300 discussed above with reference to FIG. 7, in certain embodiments, the apparatus 400 may include adjusting members 712 for adjusting a position of the ski support member 206. In certain embodiments, the adjusting members 712 are channels 714 elongated in a lengthwise direction substantially perpendicular to the longitudinal axis 210 of the ski 102 or skis 302 when the ski 102 or skis 302 are positioned in the vertical position.

A fastener 804 is received within each of the one or more channels 714. In certain embodiments, the fasteners 804 are a nut or other threaded fastener that engages the interior walls of the channel to keep the fasteners 804 from rotating. The coupling elements 702, in one embodiment, are a bolt or other threaded element that engages the threads within the fasteners 804 to couple the ski support member 206.

The fasteners 804 are movable along the one or more channels 714 in the lengthwise direction. To position a support member 206 at a desired position, the coupling elements 702 are positioned through the ski support member 206 and engaged with the fasteners 804. The fasteners engage the channels 714 to position the ski support member 206 at a desired position relative to the support structure 204.

Figure 9:
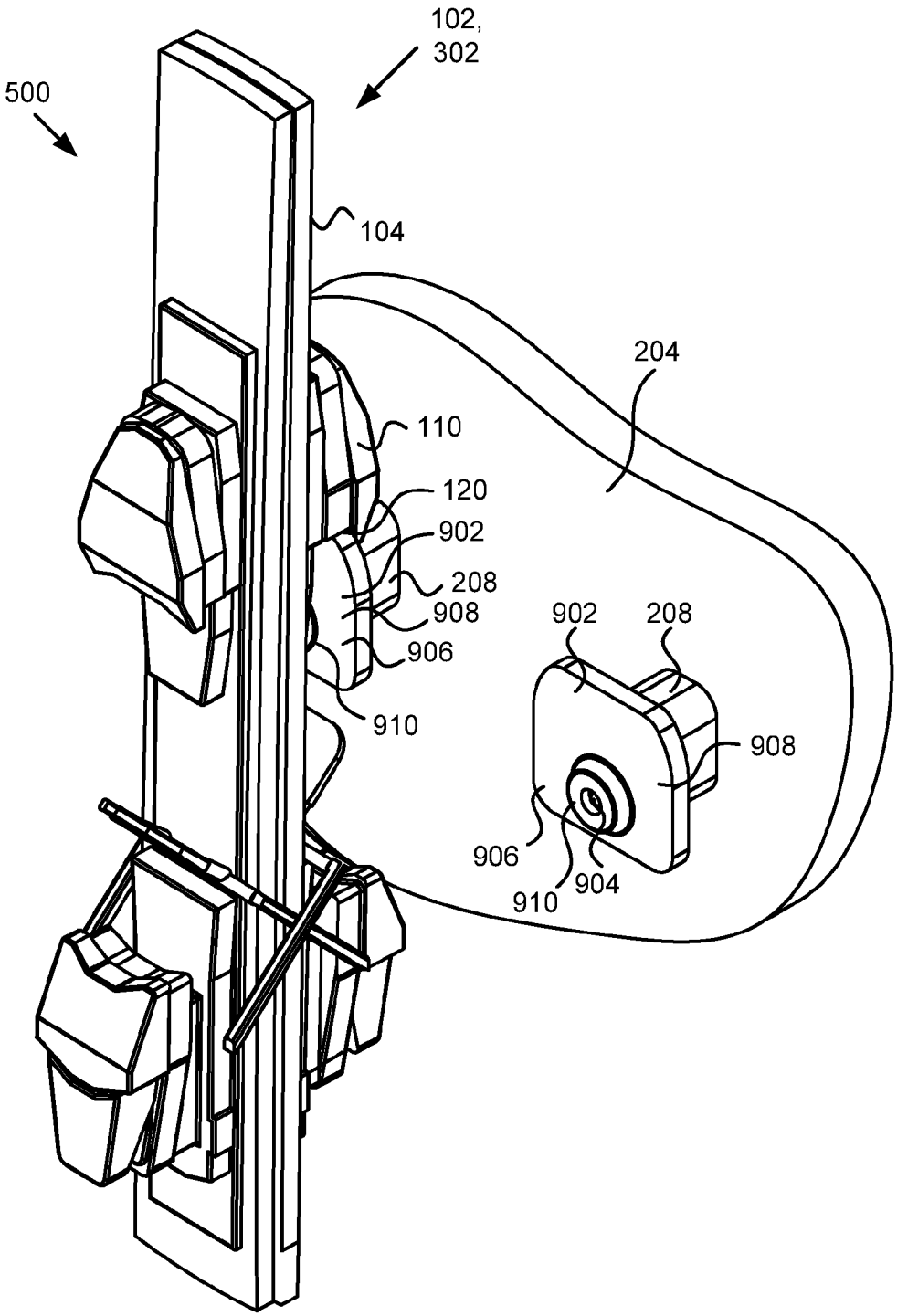
FIG. 9 depicts a front perspective view of another embodiment of an apparatus for supporting a ski or pair of skis on a support structure.

FIG. 9 depicts a perspective view of another embodiment of an apparatus 500 for supporting a ski 102 or pair of skis 302 on a support structure 204. The apparatus 500 includes a ski support member 902, a spacer 208, and a coupling element 904. In certain embodiments, the spacer 208 is substantially similar to the spacer 208 discussed above with reference to the apparatus 200.

In the embodiment illustrated in FIG. 9, the ski support member 902 has a substantially square shape with rounded corners. One of skill in the art will recognize that the shape of the ski support member 902 may be any geometric shape that will fit within the receiving space 120 in the binder toe piece 110.

In certain embodiments, the ski engaging portion 906 of the ski support member 206 has a substantially flat surface 908 engageable with one of the deck surface 104 of the ski 102 and an element disposed on the deck surface 104 of the ski 102. In one embodiment, a contact bumper 910 is coupled to the ski engaging portion 906 of the ski support member 206 such that the contact bumper 910 is positioned between the deck surface of the ski 102 and the substantially flat surface 908 of the ski engaging portion 906 of the ski support member 206 when the binder toe piece 110 is engaged with the ski support member 206.

The contact bumper 910, in certain embodiments, operates to cant the ski 102 or pair of skis 302 to avoid interference between the binder heel piece 112 and the support structure 204. As discussed above, in certain embodiments, canting the ski 102 or pair of skis 302 also helps engage the ski engaging portion 906 of the ski support member 102 with the deck surface 104 of the ski 102 or an element disposed on the deck surface 104 of the ski 102.

In one embodiment, the contact bumper 910 is made of an elastomeric material deformable with a pressure applied to the contact bumper 910 by either the deck surface 104 of the ski 102 or an element disposed on the deck surface 104 of the ski 102. The deformable material of the contact bumper 910, in certain embodiments, increases the frictional resistance of the contact bumper 910 to maintain the ski 102 in a desired orientation. In one embodiment, the deformable material of the contact bumper 910 also protects the deck surface 104 of the ski 102 or an element disposed on the deck surface 104 of the ski 102.

Figure 10:
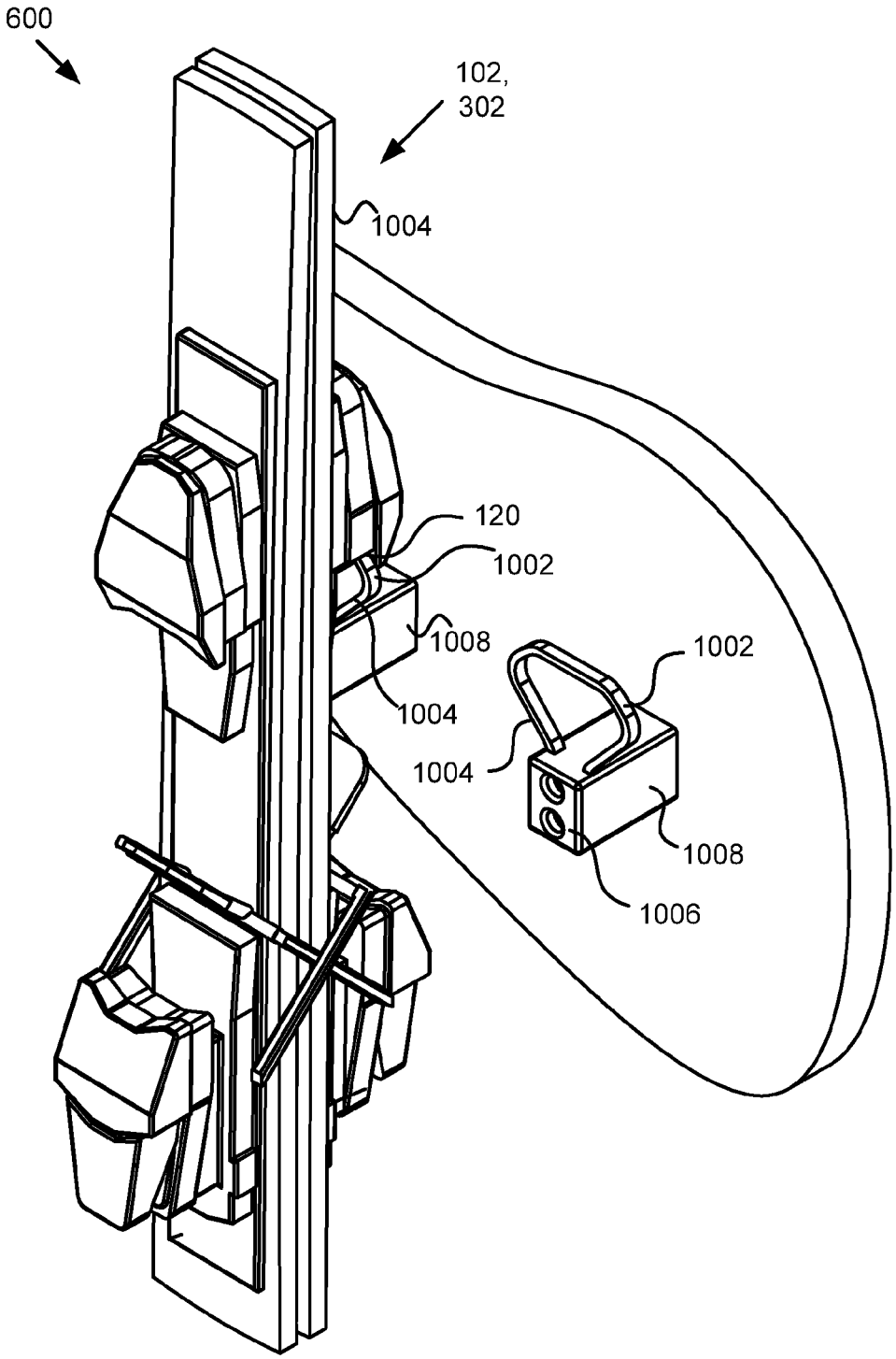
FIG. 10 depicts a front perspective view of another embodiment of an apparatus for supporting a ski or pair of skis on a support structure.

FIG. 10 depicts a perspective view of another embodiment of an apparatus 600 for supporting a ski 102 or pair of skis 302 on a support structure 204. As can be seen in the embodiment depicted in FIG. 10, the ski support member 1002 is not limited to a planar configuration.

In certain embodiments, the ski support member 1002 comprises a substantially rigid loop having a contour that matches a contour of the receiving space 120 within the binder toe piece 110 such that the ski support member 1002 is matingly receivable within the receiving space 120. In one embodiment, the ski engaging portion 1004 of the support member 1002 is substantially flat to engage the deck surface 104 of the ski 102 or an element disposed on the deck surface 104 of the ski 102. In other embodiments, an end surface 1006 of the spacer 1008 is substantially flat to engage the deck surface 104 of the ski 102 or an element disposed on the deck surface 104 of the ski 102.

Figure 11:
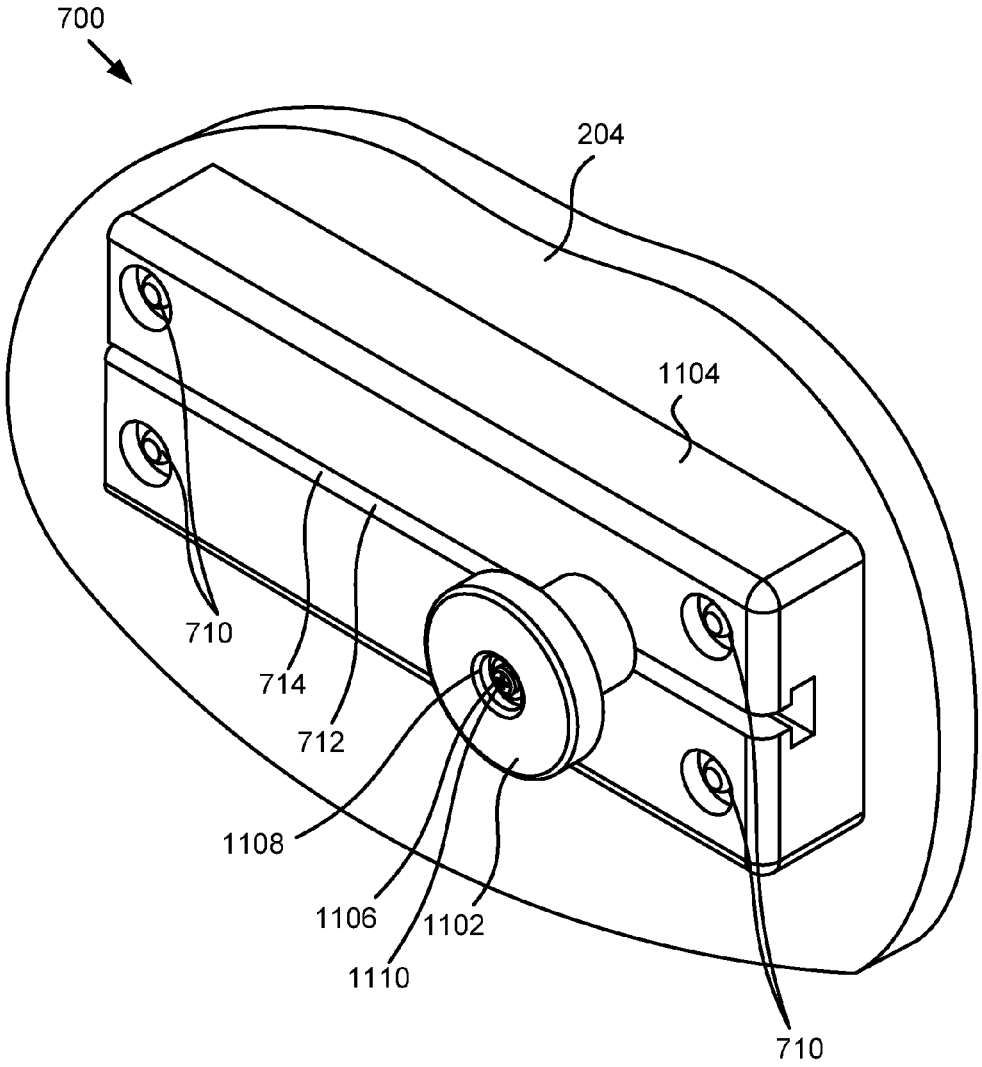
FIG. 11 depicts a front perspective view of one embodiment of an adjustable apparatus for supporting a ski or pair of skis on a support structure.

FIG. 11 depicts a perspective view of another embodiment of an apparatus 700 for supporting a ski 102 or pair of skis 302 on a support structure 204. In certain embodiments, the apparatus 700 includes a ski support member 1102, a spacer 1104, and a coupling element 1106.

The spacer 1104, in one embodiment, is an elongated member that is configured to receive one or more support members 206. The spacer 1104 is elongated in a lengthwise direction substantially perpendicular to the longitudinal axis 210 of the ski 102 or pair of skis 302.

The spacer 1104, in certain embodiments, is coupled to the support structure 204 by one or more fasteners 710, such as screws or other mechanical fasteners that extend through the spacer 1104 and engage the support structure 204. In other embodiments, the spacer 1104 is coupled to the support structure 204 by a chemical adhesive such as glue.

In certain embodiments, the apparatus 700 includes an adjusting member 712 that facilitates adjustment of a position of the ski support members 206 relative to the support structure 204. In one embodiment, the adjusting member 712 is a channel 714 elongated in a lengthwise direction substantially perpendicular to the longitudinal axis 210 of the ski 102 or skis 302 when the ski 102 or skis 302 are positioned in the vertical position.

A fastener (not shown) is received within the channel 714 and is movable along the channel 714 in the lengthwise direction. To position the support member 1102 at a desired position, a coupling element 1106 is positioned through the ski support member 1102 and engaged with the fastener. The fastener engages the channel 714 to position the ski support member 1102 at a desired position relative to the support structure 204.

In certain embodiments, both the coupling element 1106 and the fastener are threaded such that rotation of the coupling element 1106 in a first direction increases a coupling force between the ski support member 1102 and the channel 714 to limit movement of the ski support member 1102 with respect to the channel 714.

In one embodiment, the coupling element 1106 is received within a recess 1108 in the ski support member 1102. The recess 1108 is shaped to matingly receive the coupling element 1106 such that rotation of the ski support member 1102 also rotates the coupling element 1106. For example, in one embodiment the coupling element 1106 includes an octagonal head 1110 as is typically found on a bolt known in the art. The recess 1108 may also have an octagonal shape that is configured to matingly receive the octagonal head 1110 of the coupling element 1106. Rotation of the ski support member 1102 causes the coupling element 1106 to rotate. Engagement between the coupling element 1106 and the fastener increases a coupling force between the ski support member 1102 and the spacer 1104 as the coupling member 1106 is rotated in a first, tightening direction. Rotation of the coupling member 1106 in a second, opposite direction decreases the coupling force between the ski support member 1102 and the spacer 1104 such that the ski support member 1102 can be repositioned.

In one embodiment, the ski support member 1102 may be substantially cylindrical. A cylindrical ski support member 1102 allows the ski support member 1102 to engage the receiving space 120 in the binder toe piece 110 regardless of the rotational orientation of the ski support member 1102. Thus, in certain embodiments, once the ski support member 1102 has been rotated in the first direction to sufficiently increase the coupling force between the ski support member 1102 and the spacer 1104, a ski 102 or pair of skis 302 may be positioned on the ski support member 1102 regardless of the rotational orientation of the ski support member 1102.

One of skill in the art will recognize in view of this disclosure that in embodiments where the ski support member 1102 is cylindrical, the apparatus 700 may include a single adjusting member 712. In other embodiments, such as where the ski support member 206 is shaped to include a specific binder engagement portion 406 (see, e.g., FIG. 4), a second adjusting member 712 may operate to align the binder engagement portion 406 with the receiving space 120 in the binder toe piece 110 (see, e.g., FIG. 7). In such an embodiment, the second adjusting member 712 stops the ski support member 206 from rotating.

Figure 12:
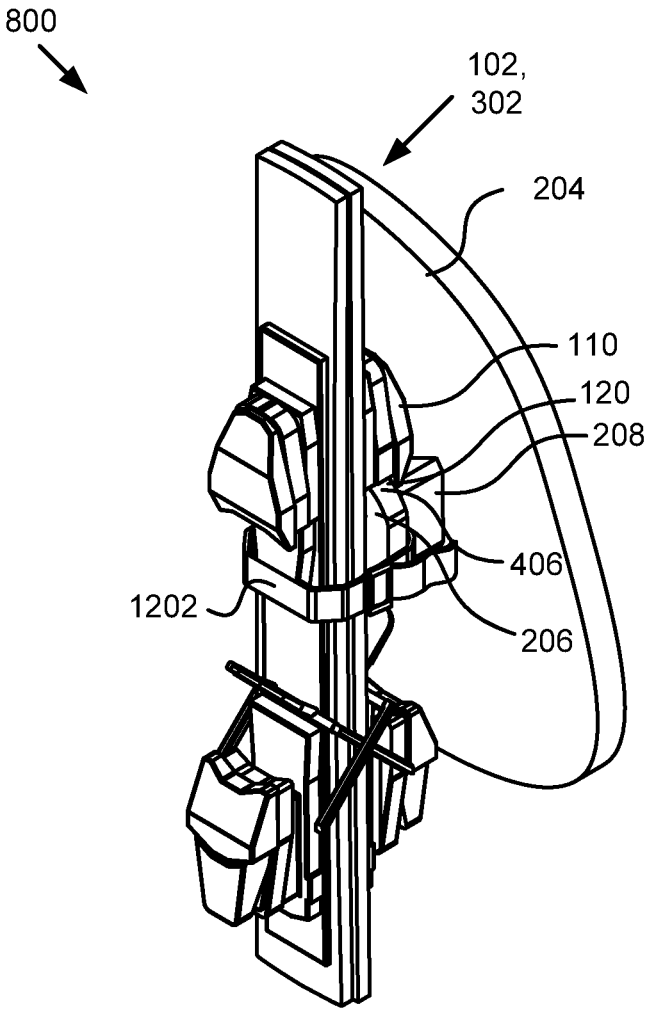
FIG. 12 depicts a front perspective view of another embodiment of an apparatus for supporting a ski or pair of skis on a support structure.

FIG. 12 depicts a perspective view of another embodiment of an apparatus 800 for supporting a ski 102 or pair of skis 302 on a support structure 204. In certain embodiments the apparatus 800 includes a ski support member 206, a spacer 208, and at least one coupling element (not shown). In one embodiment the ski support member 206, the spacer 208, and the coupling element are substantially similar to the ski support member 206, the spacer 208, and the coupling elements 402 discussed above.

In certain embodiments, the apparatus 800 includes a retention member 1202 coupled to the ski support member 206. The retention member 1202 is configured to encircle the ski 102 or skis 302 to maintain the binder engaging portion 406 of the ski support member 206 within the receiving space 120 in the binder toe piece 110.

Figure 13:
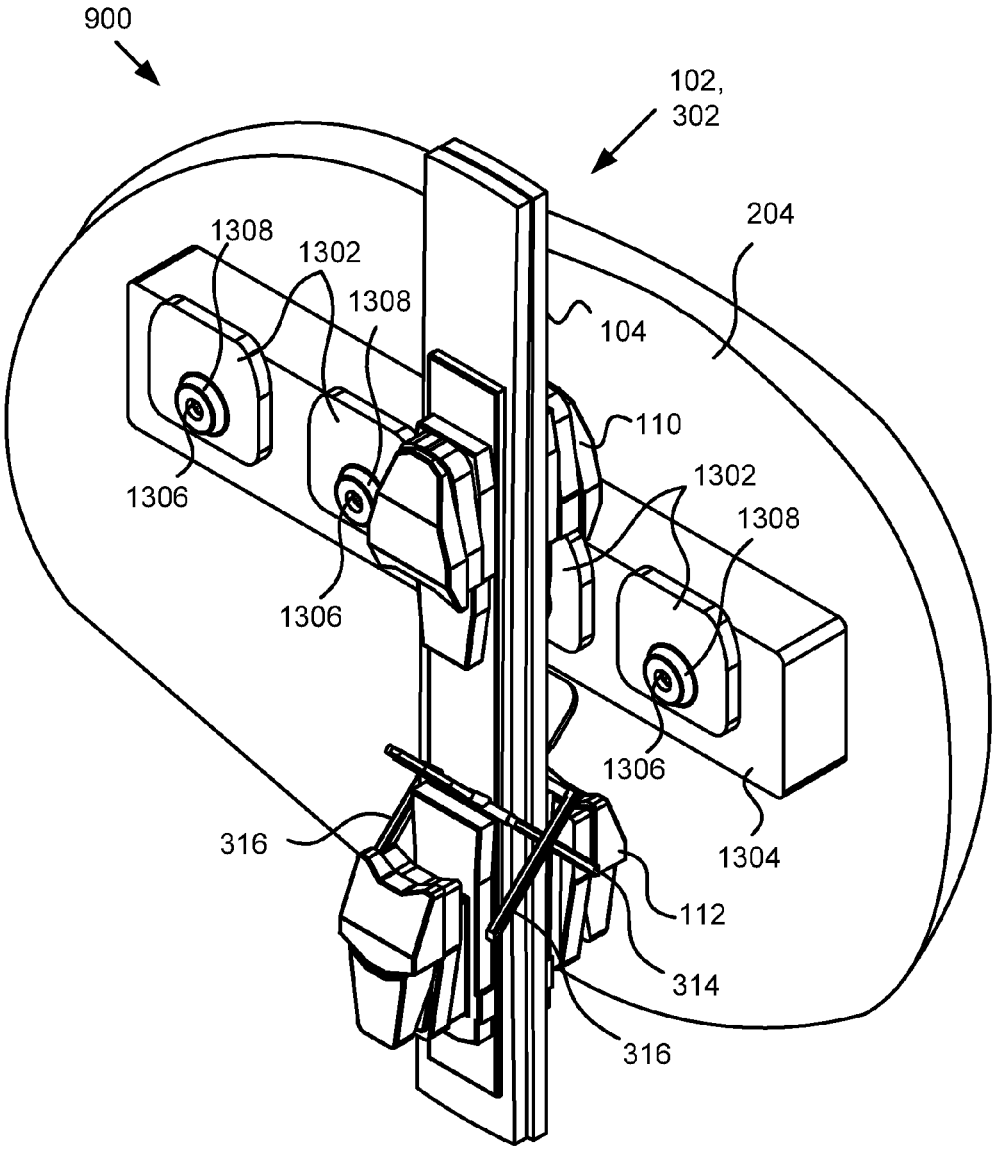
FIG. 13 depicts a front perspective view of another embodiment of an apparatus for supporting a plurality of skis or pairs of skis on a support structure.

FIG. 13 depicts a perspective view of another embodiment of an apparatus 900 for supporting a ski 102 or pair of skis 302 on a support structure 204. In certain embodiments, the apparatus 900 includes at least one ski support member 1302, a spacer 1304, and at least one coupling element 1306.

In one embodiment, a plurality of ski support members 1302 are positioned on, and coupled to, a single spacer 1304. The ski support members 1302 are positioned a sufficient distance apart to avoid interference between the ski breaking element 314, 316 of an adjacent ski 102 or a pair of skis 302.

The spacer 1304, in one embodiment, has a sufficient depth to avoid interference between the binder toe piece 110 or the binder heel piece 112 and the support structure 204. In other embodiments, contact bumpers 1308 are positioned on the ski support members 1302 between the deck surface 104 of the ski 102 and the ski support member 1302 to position the ski 102 or pair of skis 302 a sufficient distance from the support structure 204 to avoid interference between the binder toe piece 110 or the binder heel piece 112 and the support structure 204. In one embodiment, as discussed above, the contact bumpers 1308 may be configured to cant the ski to increase the pressure between the deck surface 104 of the ski 102 or an element disposed on the deck surface 104 of the ski 102. In other embodiments, the binder toe piece 110 and/or the binder heel piece 112 may contact the support structure 204. In such an embodiment the support structure 204 may assist in maintaining the deck surface 104 of the ski 102 parallel to the support structure 204.

In certain embodiments, coupling elements 1306 couple the contact bumpers 1308 and the ski support members 1302 to the spacer 1304. In one embodiment, the coupling elements 1306 also couple the spacer 1304 to the support structure 204.

Figure 14:
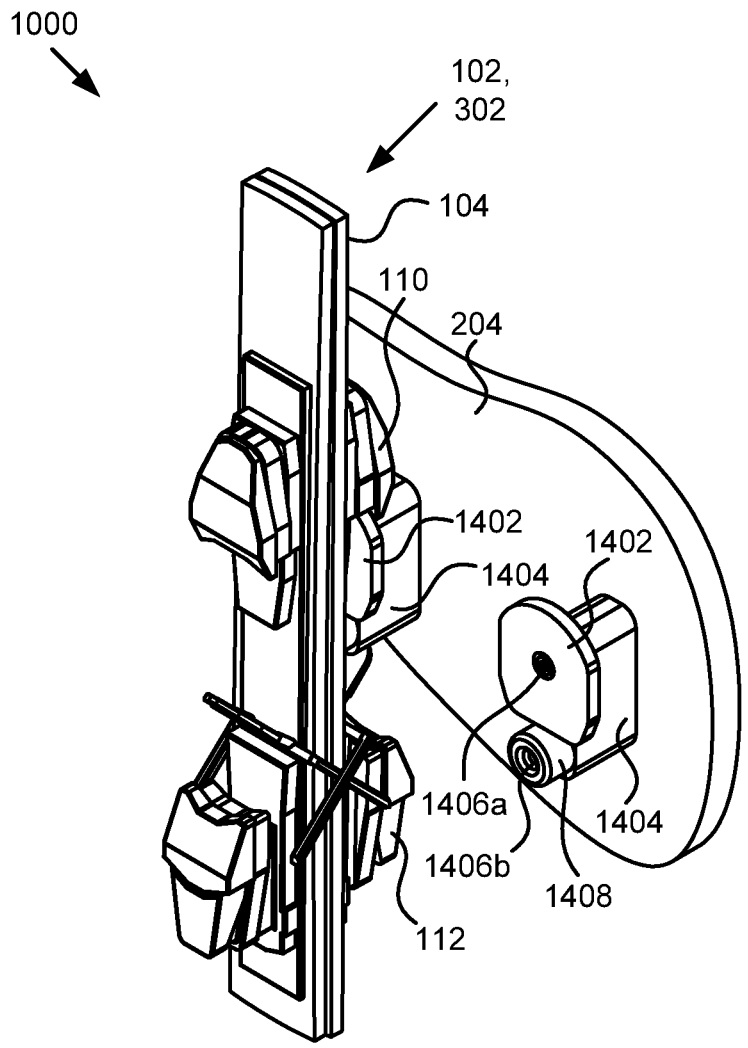
FIG. 14 depicts a front perspective view of another embodiment of an apparatus for supporting a ski or pair of skis on a support structure.

FIG. 14 depicts a perspective view of another embodiment of an apparatus 1000 for supporting a ski 102 or pair of skis 302 on a support structure 204. In certain embodiments the apparatus 1000 includes a ski support member 1402, a spacer 1404, and coupling elements 1406.

In one embodiment, the ski support member 1402 is coupled to the spacer 1404 and positions the ski 102 or pair of skis 302 a sufficient distance away from the support structure 204 to avoid interference between the binder toe piece 110 or the binder heel piece 112 and the support structure 204. In certain embodiments, a contact bumper 1408 is coupled to the spacer 1404 at a position substantially below the ski support member 1402. The contact bumper 1408 is configured to position the ski 102 or pair of skis 302 a sufficient distance away from the support structure 204 to avoid interference between the binder toe piece 110 or the binder heel piece 112 and the support structure 204. In one embodiment, the contact bumper 1408 is configured to cant the ski 102 or pair of skis 302 to increase the pressure between the contact bumper 1408 and the deck surface 104 of the ski 102 or an element disposed on the deck surface 104 of the ski 102. In other embodiments, the binder toe piece 110 and/or the binder heel piece 112 may contact the support structure 204. In such an embodiment the support structure 204 may assist in maintaining the deck surface 104 of the ski 102 parallel to the support structure 204.

In certain embodiments, a coupling element 1406*a* couples the ski support member 1402 to the spacer 1404. A second coupling element 1406*b* couples the contact bumper 1408 to the spacer 1402. In one embodiment the coupling elements 1406 also couple the spacer 1404 to the support structure 204.

Figure 15A:
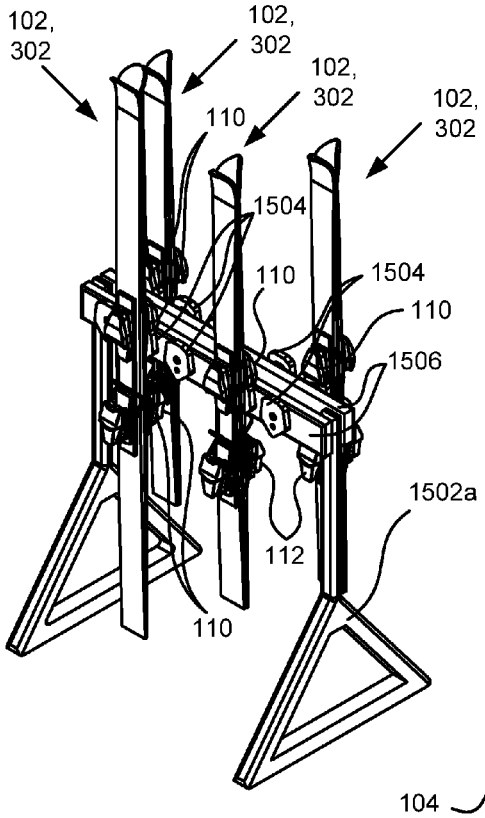
FIG. 15A depicts a front perspective view of one embodiment of a support structure and an apparatus for supporting a ski or pair of skis on the support structure.
Figure 15B:
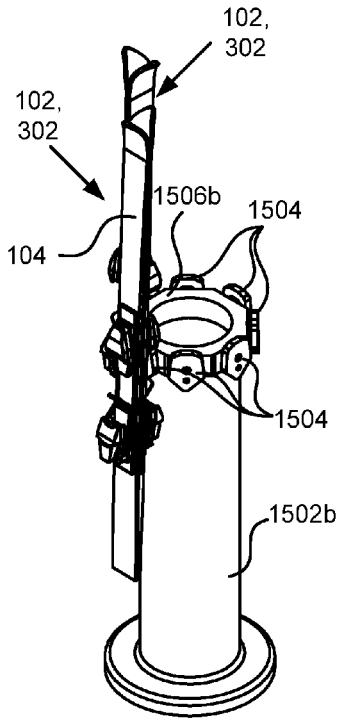
FIG. 15B depicts a front perspective view of another embodiment of a support structure and an apparatus for supporting a ski or pair of skis on the support structure.
Figure 15C:
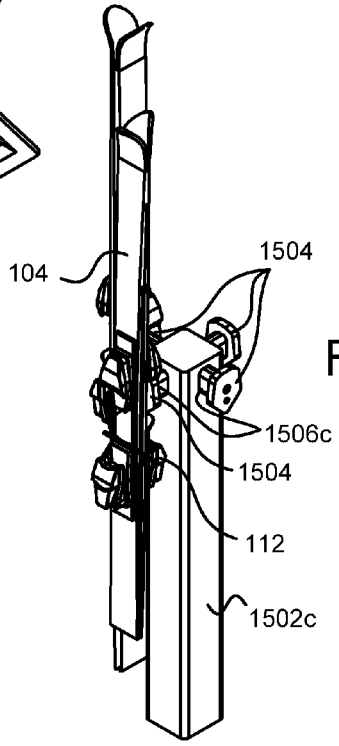
FIG. 15C depicts a front perspective view of another embodiment of a support structure and an apparatus for supporting a ski or pair of skis on the support structure.

In the embodiments described above, the apparatus' 100 through 1000 all depict the support structure 206 as a wall or a portion of a wall. One of skill in the art will recognize that in certain embodiments the apparatus' 100 through 1000 may be supported by alternative support structures. FIGS. 15A-15C depict embodiments of alternative support structures 1502.

In certain embodiments, such as the embodiment depicted in FIG. 15A, the support structure 1502*a* is free standing. In such an embodiment, the support members 1504 are positioned opposite one another and are coupled to spacers 1506*a*. The spacers 1506*a* position the skis 102 or pair of skis 302 a sufficient distance away from one another to avoid interference between the binder toe pieces 110 and the binder heel pieces 112 of each ski 102 or pair of skis 302. The support structure 1502*a*, in certain embodiments, allows for a greater number of skis 102 or pair of skis 302 to be supported in the same space.

FIG. 15B depicts an alternative arrangement for a support structure 1502*b*. In certain embodiments, the support structure 1502*b* is substantially cylindrical. Ski support members 1504 are positioned around the circumference of the cylindrical support structure 1502*b* and coupled to the spacer 1506*b*. The support structure 1502*b* may be particularly useful in a retail situation to display the deck surface 104 of the skis 102 or pair of skis 302.

FIG. 15B depicts another embodiment of a freestanding support structure 1502*c*. In certain embodiments the support structure 1502*c* is a post having ski support members 1504 positioned on each of the post's four sides. Spacers 1506*c* position the ski support members 1504 a sufficient distance away from the support structure 1502*c* to avoid interference between the support structure 1502*c* and the binder heel pieces 112 of the skis 102. One of skill in the art will recognize that the support structure 1502*c* depicted in FIG. 15C, like the support structures 1502*a* and 1502*b*, allows the deck surfaces 104 of the ski's 102 or pair of skis 302 to be conveniently displayed.

The present subject matter may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for supporting a ski on a support structure, the ski having a binder toe piece and a binder heel piece coupled to a deck surface of the ski, the binder toe piece having a boot retention flange extending parallel to the deck surface of the ski, wherein the deck surface and the boot retention flange define a receiving space for receiving a toe end of a ski boot, the apparatus for supporting a ski comprising:

a ski support member comprising a ski engaging portion and a binder engaging portion, the binder engaging portion of the ski support member including a first surface positioned opposite a second surface with an end surface extending between the first surface and the second surface, the binder engaging portion being positionable within the receiving space to engage the binder toe piece in an engaged position, wherein in the engaged position the end surface is positioned within the receiving space and wherein the first surface engages the boot retention flange, the ski engaging portion having a substantially flat surface engageable with at least one of the deck surface of the ski and an element disposed on the deck surface of the ski to maintain the ski in a desirable orientation, wherein the binder heel piece is substantially free from engagement with the ski support member;

a spacer positioned between the ski support member and the support structure; and a coupling element configured to couple the ski support member to the support structure.

2. The apparatus of claim 1, wherein the desirable orientation comprises a vertical orientation, the ski having a longitudinal axis, and wherein in the vertical orientation the longitudinal axis of the ski is substantially vertical and the deck surface of the ski faces the support structure.

3. The apparatus of claim 1, further comprising a retention member coupled to the ski support member, the retention member configured to encircle the ski to maintain the binder engaging portion within the receiving space.

4. The apparatus of claim 1, wherein engagement between the ski engaging portion and the at least one of the deck surface of the ski and the element disposed on the deck surface of the ski prevents rotation of the ski about a transverse axis substantially parallel to the deck surface of the ski, wherein positioning of the binder engaging portion of the ski support member within the receiving space prevents rotation of the ski about a longitudinal axis and a third axis, the longitudinal axis comprising an axis substantially perpendicular to the transverse axis, the third axis substantially perpendicular to the longitudinal axis and substantially perpendicular to the transverse axis.

5. The apparatus of claim 4, wherein the end surface is contoured to match a contour of the receiving space such that the binder engaging portion of the ski support member is matingly receivable within the receiving space.

6. The apparatus of claim 1, further comprising an adjusting member that facilitates adjustment of a position of the ski support member relative to the support structure.

7. The apparatus of claim 6, further comprising a fastener and wherein the adjusting member comprises a channel elongated in a lengthwise direction substantially perpendicular to a longitudinal axis of the ski, the fastener receivable within the channel and movable along the lengthwise direction, wherein the coupling element is positionable through the ski support member and engageable with the fastener, wherein the fastener engages the channel to position the ski support member at a desired position relative to the support structure.

8. The apparatus of claim 7, wherein the coupling element and the fastener are threaded such that rotation of the coupling element in a first direction increases a coupling force between the ski support member and the channel to limit movement of the ski support member with respect to the channel.

9. The apparatus of claim 1, further comprising a contact bumper positioned between the deck surface of the ski and the substantially flat surface of the ski engaging portion of the ski support member.

10. The apparatus of claim 9, wherein the contact bumper comprises an elastomeric material deformable upon receipt of a pressure applied by the at least one of the deck surface of the ski and the element disposed on the deck surface of the ski.

11. The apparatus of claim 1, wherein the binder engaging portion of the ski support member comprises a substantially rigid loop having a contour that matches a contour of the receiving space such that the substantially rigid loop is matingly receivable within the receiving space.

12. An apparatus for supporting a ski on a support structure, the ski having a binder toe piece and a binder heel piece coupled to a deck surface of the ski, the binder toe piece having a boot retention flange extending parallel to the deck surface of the ski, wherein the deck surface and the boot retention flange define a receiving space for receiving a toe end of a ski boot, wherein the binder heel piece includes a ski braking element, the apparatus for supporting a ski comprising:

a ski support member comprising a ski engaging portion and a binder engaging portion, the binder engaging portion of the ski support member including a first surface positioned opposite a second surface with an end surface extending between the first surface and the second surface, the binder engaging portion being positionable within the receiving space to engage the binder toe piece in an engaged position, wherein in the engaged position the end surface is positioned within the receiving space and wherein the first surface engages the boot retention flange, the ski engaging portion having a substantially flat surface engageable with at least one of the deck surface of the ski and an element disposed on the deck surface of the ski to maintain the ski in a desirable orientation, wherein the ski braking element of the binder heel piece is substantially free from engagement with the ski support member and wherein the ski braking element is engageable with a second ski braking element of a second binder heel piece on a second ski to support the second ski;

a spacer positioned between the ski support member and the support structure; and a coupling element configured to couple the ski support member to the support structure.

13. The apparatus of claim 12, wherein the desirable orientation comprises an orientation that positions a longitudinal axis of the ski substantially parallel to the support structure with the deck surface of the ski facing the support structure.

14. The apparatus of claim 12, wherein the desirable orientation comprises a vertical orientation, the ski having a longitudinal axis and wherein the longitudinal axis of the ski is substantially vertical with the deck surface of the ski facing the support structure in the vertical orientation.

15. The apparatus of claim 12, wherein engagement between the ski engaging portion and one of the deck surface of the ski and an element disposed on the deck surface of the ski further inhibits rotation of the ski about a transverse axis substantially parallel to the deck surface of the ski, wherein positioning of the binder engaging portion of the ski support member within the receiving space prevents rotation of the ski about a longitudinal axis and a third axis, the longitudinal axis comprising an axis substantially perpendicular to the transverse axis, the third axis substantially perpendicular to the longitudinal axis and substantially perpendicular to the transverse axis.

16. The apparatus of claim 12, further comprising an adjusting member that facilitates adjustment of a position of the ski support member relative to the support structure.

17. An apparatus for supporting a ski on a support structure, the ski having a binder toe piece and a binder heel piece coupled to a deck surface of the ski, the binder toe piece having a boot retention flange extending parallel to the deck surface of the ski, wherein the deck surface and the boot retention flange define a receiving space for receiving a toe end of a ski boot, the apparatus for supporting a ski comprising:

a ski support member comprising a ski engaging portion and a binder engaging portion, the binder engaging portion of the ski support member including a first surface positioned opposite a second surface with an end surface extending between the first surface and the second surface, the binder engaging portion being positionable within the receiving space to engage the binder toe piece in an engaged position, wherein in the engaged position the end surface is positioned within the receiving space and wherein the first surface engages the boot retention flange, the ski engaging portion having a substantially flat surface engageable with at least one of the deck surface of the ski and an element disposed on the deck surface of the ski to maintain the ski in an orientation that positions a longitudinal axis of the ski substantially parallel to a vertical axis of the support structure with the deck surface of the ski facing the support structure, wherein the binder heel piece is substantially free from engagement with the ski support member;

a spacer positioned between the ski support member and the support structure; and a coupling element configured to couple the ski support member to the support structure.

18. The apparatus of claim 17, wherein engagement between the ski engaging portion and the at least one of the deck surface of the ski and the element disposed on the deck surface of the ski prevents rotation of the ski about a transverse axis substantially parallel to the deck surface of the ski, wherein positioning of the binder engaging portion of the ski support member within the receiving space prevents rotation of the ski about the longitudinal axis, the longitudinal axis comprising an axis substantially perpendicular to the transverse axis, wherein the end surface is contoured to match a contour of the receiving space such that the binder engaging portion of the ski support member is matingly receivable within the receiving space.

19. The apparatus of claim 17, further comprising an adjusting member that facilitates adjustment of a position of the ski support member relative to the support structure.

* * * * *